US005196647A

United States Patent [19]

Majors

[11] Patent Number: 5,196,647

[45] Date of Patent: Mar. 23, 1993

[54] DOOR UNLOCKING DEVICE AND METHOD

[76] Inventor: J. Paul Majors, 102 S. Riley, Greenfield, Ind. 46140

[21] Appl. No.: 602,164

[22] Filed: Oct. 23, 1990

[51] Int. Cl.[5] ..... F12D 3/00

[52] U.S. Cl. ..... 102/303; 102/302; 89/1.14; 70/262

[58] Field of Search ..... 70/262; 89/1.14; 102/302, 303

[56] References Cited

U.S. PATENT DOCUMENTS

| | | | |
|---|---|---|---|
| 3,218,927 | 11/1965 | Stott | 89/1.14 |
| 3,885,761 | 5/1975 | Pendergast et al. | 89/1.14 X |
| 3,983,892 | 10/1976 | Hardesty | 89/1.14 X |
| 4,187,759 | 2/1980 | Toy et al. | 89/1.14 X |
| 4,282,714 | 8/1981 | Fiocchi | 60/632 |
| 4,848,209 | 7/1989 | Almeras | 89/1.14 |
| 4,856,430 | 8/1989 | Gibb et al. | 89/1.14 X |
| 4,978,089 | 12/1990 | Alquier et al. | 89/1.14 X |

*Primary Examiner*—Peter A. Nelson
*Attorney, Agent, or Firm*—Baker & Daniels

[57] ABSTRACT

The invention comprises a device and method for forcibly opening a locked door. A sealed chamber is adapted to sealably receive the barrel of conventional firearm. A piston in the sealed chamber is connected to a ramming plate. A blank cartridge is placed in the firearm and detonated, pressurizing the chamber and forcing the ramming plate against the exterior of the door with great force and speed. After the piston moves a predetermined distance, the chamber is vented and a spring returns the piston and ramming plate to their original position. The procedure may be rapidly repeated as many times as may be necessary to force the door open.

20 Claims, 3 Drawing Sheets

DOOR UNLOCKING DEVICE AND METHOD

FIELD OF THE INVENTION

This invention relates to devices and methods for forcibly opening locked doors.

BACKGROUND OF THE INVENTION

When undertaking law enforcement procedures such as drug raids, law enforcement officers often find it necessary to forcibly enter a premises through a door that is locked. One known methods for gaining such access is to shoot bullets into the locks of the door until the locks are rendered inoperative. However, this method has the shortcoming of being extremely dangerous as the bullets may injure an occupant on the opposite side of the door, or may ricochet off the lock and injure the law enforcement officer. In addition, bullets are likely to inflict unnecessary damage to items in the premises after passing through the door.

Another known method for opening a locked door is by use of what is referred to in the art as a "universal key," namely, a battering ram or twelve pound sledgehammer. With such a ram, one or more law enforcement officers hold the ram and repeatedly strike it against the door with great force until the door is forced open. However, this method also has numerous shortcomings. Use of a battering ram requires that the law enforcement officers position themselves in front of the door to apply the ram. Being so located, the law enforcement officers are easier targets of gunshots directed through the door fired by the occupants of the premises. In addition, the use of a battering ram is a relatively slow and noisy procedure, and accordingly, it gives the occupants of the premises an earlier opportunity to learn of the attempted entry, and to escape or prepare to resist the entry. Also, the use of a battering ram is more likely to cause serious injury to the door jamb and other areas of the premises surrounding the door, thus unnecessarily inflicting property damage. Finally, a battering ram by its very nature is heavy and requires a significant amount of physical strength to successfully use the device. Therefore, a battering ram may be suitably used only by law enforcement officers possessing sufficient strength.

Another known method for disabling a locked door is through the use of explosive devices. With this procedure, one or more explosive charges are positioned around the edges of a door adjacent to the door frame. All charges are wired to a common detonation system, and detonated simultaneously. This results in the door being literally blown off the premises with great force and speed. Although this method allows quick entry once the charges are detonated, it also has numerous shortcomings. Obviously, a flying door propelled by explosive charges can inflict serious injury on occupants inside the premises who happen to be near the door when the charges are detonated. Additionally, the explosive charges inflict a large amount of property damage upon the premises. Also, a significant amount of time is required to properly position the explosives and prepare them for detonation. Thus, this technique is ill-suited for situations were access must be quickly gained through the locked door. In addition, the law enforcement officers positioning the explosive charges around the door are necessarily located in front of the door, and are thereby a likely target of gunshots fired through the door from inside the premises. Finally, only individuals specially trained in explosives are suitable for using this technique, as a slight miscalculation in the amount of explosives to use can result in serious injury to persons and property. Persons with specialized training may not be readily available during a law enforcement operation when it is determined that access through a locked door is necessary.

Explosive actuated tools are well known in the construction industry, but such devices are not known to be used in unlocking doors or for law enforcement purposes. Examples of explosive actuated devices are shown in representative U.S. Pat. Nos. 4,282,714 and 4,848,209.

OBJECTS OF THE INVENTION

Accordingly, it is an object of the invention to provide a device and method for unlocking a locked door that does not require any specialized training.

It is a further object of the invention to provide a device and method for unlocking a locked door that is very fast and unlikely to give occupants of a premises advance notice of the attempted entry.

It is a further object of the invention to provide a device and method for unlocking a locked door that does not require great strength to use.

It is a further object of the invention to provide a device and method for unlocking a locked door that does not require that a person position themselves in front of the door to be unlocked.

It is a further object of the invention to provide a device and method for unlocking a locked door that is lightweight, portable and easy to use.

It is a further object of the invention to provide a device and method for unlocking a locked door that is inexpensive to construct and use.

It is a further object of the invention to provide a device and method for unlocking a locked door that is may be actuated by and retrofitted to a conventional firearm.

SUMMARY OF THE INVENTION

Figure 1:
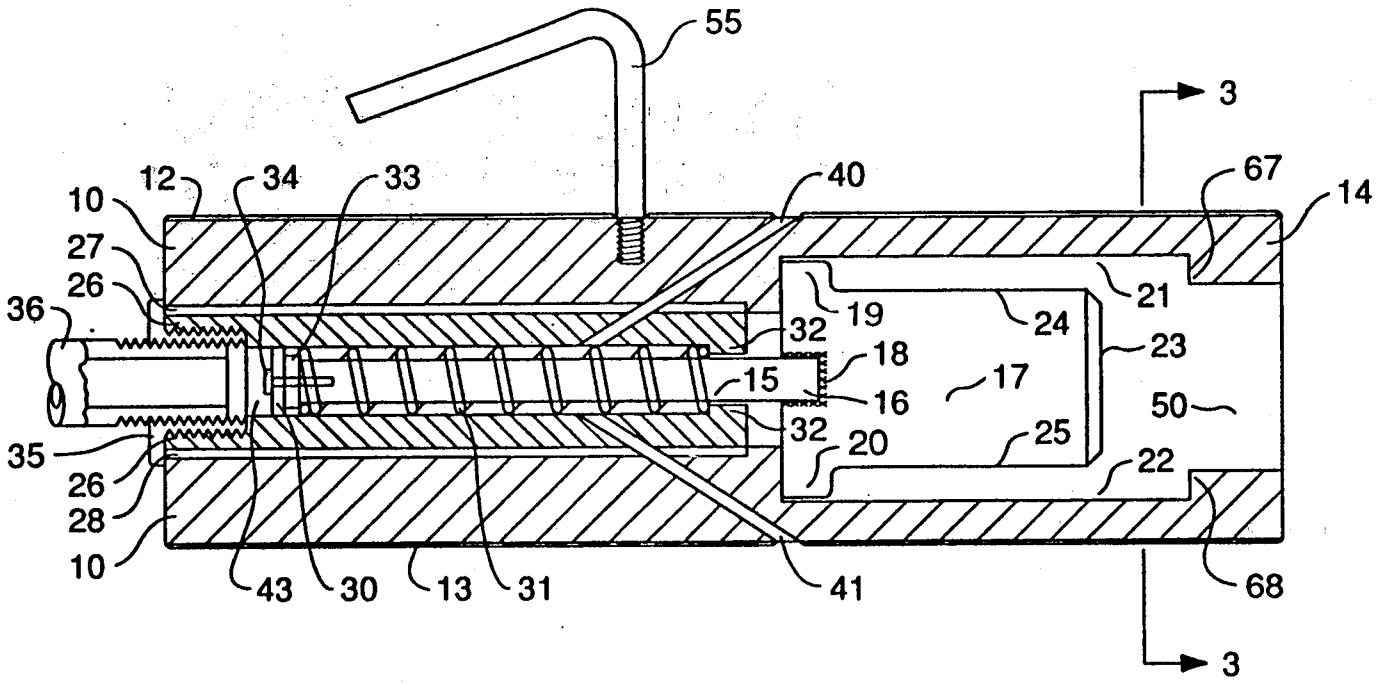
FIG. 1 is a partial section of the door unlocking device of the present invention showing the blade in its retracted position.

The invention comprises a device and method for opening a locked door. A sealed chamber is adapted to sealably receive the barrel of conventional firearm. A piston in the sealed chamber is connected to a ramming plate. A blank cartridge is placed in the firearm and detonated, pressurizing the chamber and forcing the ramming plate against the exterior of the door with great force and speed. After the piston moves a predetermined distance, the chamber is vented and a spring returns the piston and ramming plate to their original position. The procedure may be rapidly repeated as many times as may be necessary to force the door open.

Detailed Description

One embodiment of the invention comprises a generally rectangular housing which is preferably molded from 4140 steel in two half sections 10 and 11, hardened to 45–50 Rockwell, and welded together at their seams by upper and lower welds 12 and 13. The front end 14 of housing is a door engaging surface and may be positioned against a door. Within the housing is piston 15 which is formed from 01 steel and cut with a central notch at end 16 to receive ramming plate 17, which is welded to piston end 16 by weld 18. Ramming plate 17 is formed from ¼ in. thick SR7 tempered steel or 01 steel or equivalent, and includes upper and lower ears 19 and 20, which fit into opposing guide rails 21, 22 of the housing to permit reciprocation of ramming plate 17 along guide rails 21, 22. Ramming plate 17 includes a door engaging edge 23 which is beveled at a 45° angle to form a flat blade that is distally spaced from ears 19, 20. Upper and lower edges 24, 25 of ramming plate 17 are slightly tapered toward door engaging face 23 to help prevent ramming plate 17 from jamming or binding in guide rails 21 and 22, and to aid in rapid removal from the door material.

Figure 3:
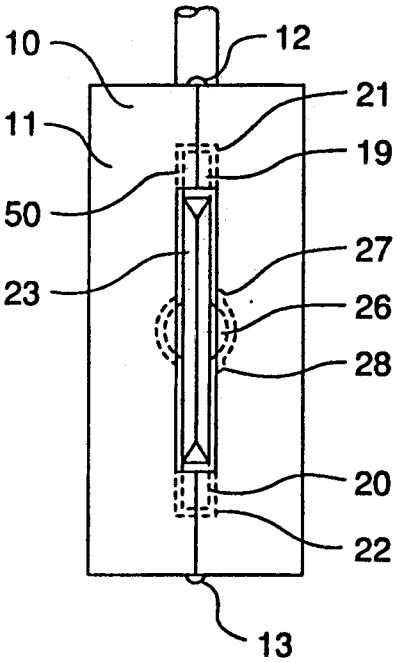
FIG. 3 is an end view of the door unlocking device of the present invention taken along the lines 3—3 of FIGS. 1 and 2.

Piston 15 is reciprocable in barrel 26, which is cut from a Browning 50 caliber machine gun barrel or equivalent made of 4140 steel or equivalent and the bore of which is reamed by a 0.505 in. reamer to remove the rifling. However, the reaming is not performed through the entire length of the bore. A short portion 32 is not reamed to form a lip, which serves as a spring retainer. Barrel 26 is circular in cross section, and is welded to housing 10 by welds 27, 28, which are located in two recesses in housing 10 as shown in FIG. 3. Piston 15 is sealed in barrel 26 by seal 30, which is preferably formed of nylon or similar material and able to withstand high pressures and temperatures. Compression spring 31 surrounds piston 15, and biases piston 15 toward its retracted position as shown in FIG. 1. Spring 31 is held within barrel 26 by barrel lip 32 and retaining washer 33. Seal 30 and retaining washer 33 are secured to piston 15 by hardened steel screw 34.

Fitted at the rear end of barrel 26 is barrel adapter 35, which is both internally and externally threaded. The external threads of barrel adapter mate with the internal threads of barrel 26, and the internal threads of barrel adapter mate with external threads cut into the end of barrel 36 of a conventional firearm, such as a Ruger rifle (i.e., mini 14, mini 30, AR15 or AR16.) Piston 15, barrel 26, barrel 36 and barrel adapter 35 combine to form a sealed expandable pressure chamber 43, and piston 15 comprises a movable wall portion of chamber 43. However, firearm barrel 36 may be easily detached from adapter 35 by unscrewing firearm barrel 36 from barrel adapter 35.

Figure 2:
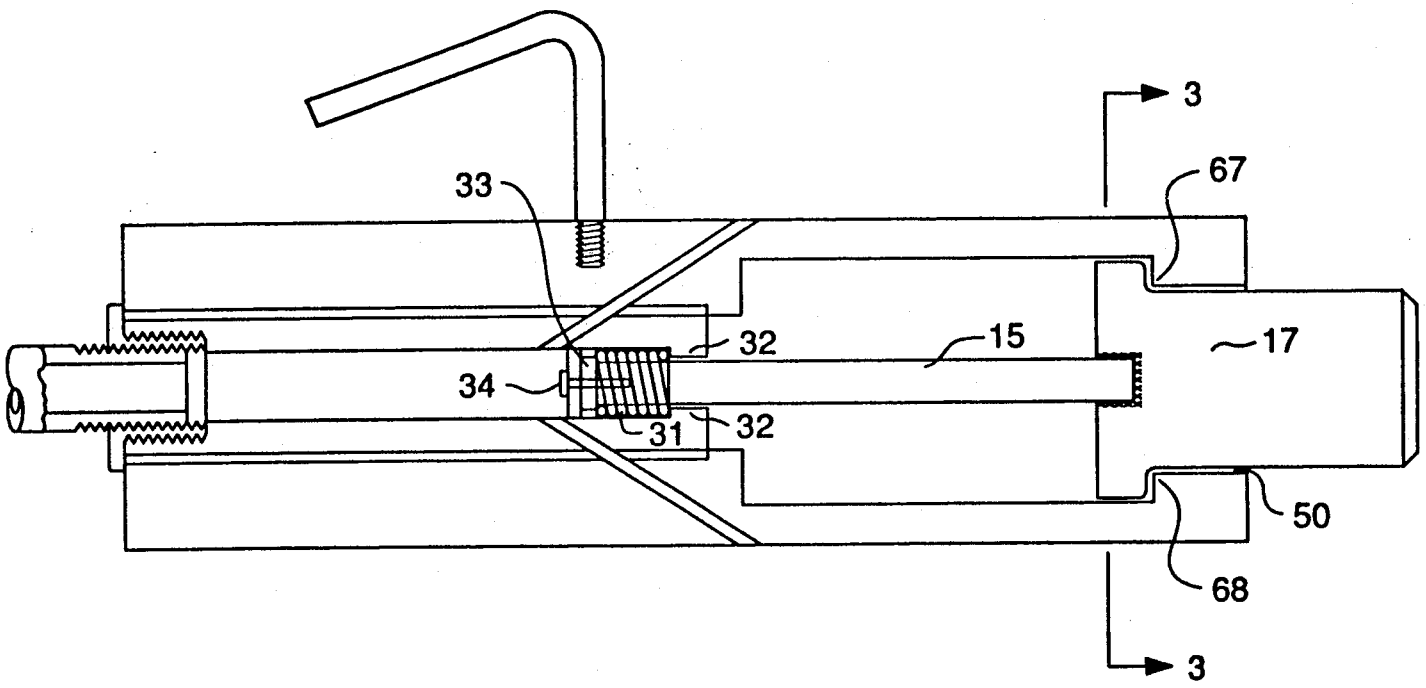
FIG. 2 is a partial section of the door unlocking device of the present invention showing the blade in its extended position.

Vents 40, 41 are drilled through housing sections 10, 11 and barrel 26 to provide a venting means for sealed pressure chamber 43. However, such venting occurs only when piston 15 moves from its retracted position shown in FIG. 1 to its extended position shown in FIG. 2. Vents 40, 41 are angled toward the front of the device so that hot gases escaping therethrough are not directed toward the person using the device. Although two vents are shown in FIG. 1 and 2, it is also possible to drill four vents with a no. 30 drill bit, each vent being perpendicular to its adjacent two vents.

The housing is configured to form an opening 50 in its door engaging surface 14. As shown in FIG. 2, when piston 15 and ramming plate 17 are in their extended position, ramming plate 17 projects from opening 50. In addition, sealed pressure chamber 43 is larger when piston 15 is in its extended position. The device of the present invention may be easily held by handle 55, which is screwed into the top of the device.

Figure 4:
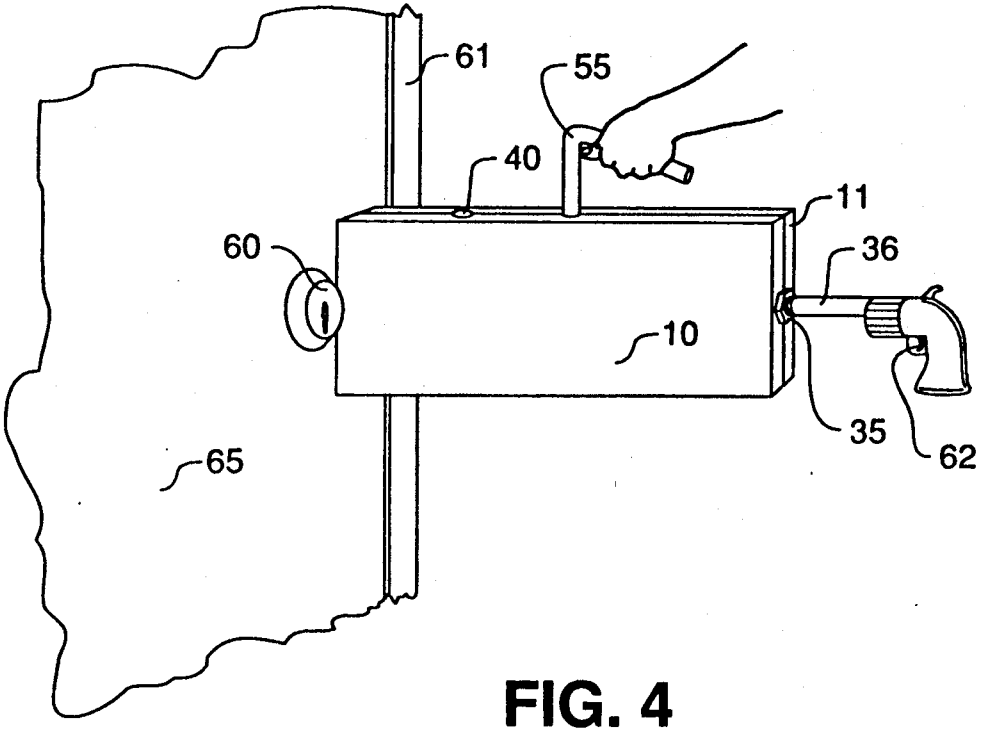
FIG. 4 is a perspective view showing placement of the unlocking device of the present invention against a locked door.

The device of the invention may be preferably utilized by the following procedure. First, external threads are cut into the end of the barrel of a conventional firearm, and the barrel is screwed into barrel adapter 35. In the preferred embodiment, the firearm is of the self-breaching type, so that the firearm barrel is automatically vented and the cartridge ejected upon build-up of a predetermined pressure in the barrel. Use of this type of firearm is safer because it will prevent the device from exploding should the piston, for some reason, become jammed in its retracted position. However, if the device were to be used with sealed system firearm such as a single shot firearm, an additional very narrow vent should be drilled to sealed chamber 43. This will act as a safety valve if piston 15 becomes jammed, but still provide sufficient force to utilize the device effectively if the device is not jammed. An explosive charge, preferably a blank cartridge such as a grenade launching blank, is placed in the firearm. As shown in FIG. 4, the door engaging surface of the device is placed against a locked door, preferably at the location between lock 60 and door frame 61. At this position, the user may stand to the side of the door to be protect from any gunshots occupants of the premises may fire through the door. Firearm trigger 62 is pulled to detonate the explosive charge in the cartridge blank. This results in a large and rapid pressure increase in sealed chamber 43, which causes piston 15 and ramming plate 17 to move from their retracted positions shown in FIG. 1 to their extended position shown in FIG. 2. The "ramp-up" distance in FIG. 1 between door engaging edge 23 and door engaging surface 14 (about 2 in.) allows ramming edge 23 to accelerate to a high rate of speed and thereby strike door 65 with great force. The impact forces the bolt of the lock to defect to such an extent to render the lock inoperative and force the door open. As ramming plate 17 moves forward, ears 19 and 20 will engage stops 67 and 68 of guide rails 21 and 22, to thereby prevent further forward movement of ramming plate 17. In addition, the combination of screw 34, retaining washer 33 and spring 34 against barrel lip 32 also serves as an additional stop for movement of piston 15. At this point, piston 15 will have moved past vents 40, 41, thus permitting the pressurized gasses in sealed chamber 43 to escape. Once these gasses have escaped, the pressure in sealed chamber 43 will be reduced, and piston 15 and ramming plate 17 will return to their retracted positions as shown in FIG. 1 under the force of compression spring 31. Assuming the firearm employed is the preferred semi-automatic type of conventional firearm, the blank cartridge will be expelled from the firearm and a new cartridge loaded in its place. Therefore, if the door was not opened after first attempt, trigger 62 may be pulled again to repeat the procedure as many times as may be necessary. It will be appreciated that the trigger may be pulled many times in a span of a few seconds, so the door may be opened very quickly without giving the occupants of the premises sufficient time to escape or retaliate. In addition, if a door has multiple locks, the device and may be easily raised or lowered to the location of those locks and the above procedure repeated until all locks have been rendered inoperative.

It will be appreciated by those skilled in the art that the foregoing device and method provide a means for opening a locked door achieving each of the above objectives. The device is inexpensive to manufacture and use, and does not require any specialized training or strength. The device may be powered by a conventional firearm, and may open a locked door very quickly without giving the occupants of the premises advance notice. Additionally only minor damage is inflicted upon the locked door, and since no projectiles enter the premises, safety of the occupants of the premises is ensured. Furthermore, a person need not be located in fron of the door to use the device.

I claim:

1. A device for forcibly opening a locked door comprising:

a housing having a door engaging surface, the door engaging surface having an opening, a plurality of guide rails, a door ramming member reciprocable within the guide rails, the door ramming member being movable between a first retracted position wherein the ramming member does not project from the opening, and a second extended position in which the door ramming member projects from the opening, the housing and door ramming member having cooperating stop means to limit the extent to which the ramming member can project from the opening, pressure chamber defining means connected to the housing, the pressure chamber defining means comprising a reciprocable piston within the pressure chamber, the piston being connected to the door ramming member, means for sealably connecting the pressure chamber defining means to the barrel of a firearm to create a sealed chamber, such that upon detonation of an explosive charge in the pressure chamber defining means, pressure in the chamber is increased so that the piston forces the ramming member from its retracted position to its extended position.

2. The device of claim 1, wherein the pressure chamber defining means further comprises vent means for venting pressure from the pressure chamber defining means when the piston moves the door ramming member a predetermined distance from the retracted position toward the extended position.

3. The device of claim 1 further comprising means for biasing the door ramming member toward the retracted position.

4. The device of claim 3 wherein the bias means comprises a compression spring.

5. The device of claim 1 further comprising a firearm having a barrel detachably connected to the sealably connecting pressure chamber means.

6. The device of claim 5 wherein the firearm further comprises a barrel, and a bolt that automatically opens to vent pressure from the barrel of the firearm upon the formation of pressure in the barrel.

7. The device of claim 1 wherein the door ramming member comprises a generally rectangular plate comprising an elongate door engaging edge, upper and lower edges, and wherein the door ramming member stop means comprise an ear on each upper and lower edge, the ears being spaced from the door engaging edge.

8. A device for opening a locked door comprising:

a housing having a door engaging surface, the door engaging surface having an opening, a plurality of guide rails, a generally thin elongate door ramming surface reciprocable within the guide rails, the door ramming surface being movable between a first retracted position wherein the door ramming surface does not project from the opening, and a second extended position in which the door ramming surface projects from the opening, the housing and door ramming member having cooperating stop means to limit the extent to which the door ramming surface can project from the opening, pressure chamber means connected to the housing, the pressure chamber means comprising a reciprocable piston within the pressure chamber, the piston being connected to the door ramming surface, such that upon detonation of an explosive charge in the sealed pressure chamber, pressure in the sealed chamber is increased so that the piston forces the ramming member from its retracted position to its extended position.

9. The device of claim 8 wherein the pressure chamber means comprises:

a barrel engaging the piston, a firearm barrel, and means sealably connecting the firearm barrel to the barrel.

10. The device of claim 8, wherein the pressure chamber means further comprises vent means for venting pressure from the pressure chamber means when the piston moves the door ramming surface a predetermined distance from the retracted position toward the extended position.

11. The device of claim 8 further comprising a compression spring biasing the door ramming surface toward the retracted position.

12. The device of claim 8 wherein the door ramming surface stop means comprise ears spaced from the door engaging edge.

13. A method for forcibly opening a locked door, comprising the steps of:

providing an expandable sealed chamber, the sealed chamber being defined in part by a movable wall portion, the movable wall portion being movable between a retracted position and an extended position such that the volume of the sealed chamber is greater when the movable wall portion is in the extended position than when it is in the retracted position, the movable wall portion being connected to a door ramming surface, providing a means for limiting the extent to which the movable wall portion may be moved toward its extended position, providing an explosive charge within the sealed chamber, placing the movable wall portion in the retracted position, positioning the door ramming surface so that it will strike the locked door upon movement of the movable wall portion from the retracted position to the extended position, and detonating the explosive charge in the sealed chamber to thereby increase the pressure in the sealed chamber and cause the movable wall portion to move from its retracted position to its extended position and thereby ram the ramming surface against the door.

14. The method of claim 13 further comprising the step of venting the pressure from the enclosed chamber after the movable wall portion has moved a predetermined distance from the retracted position toward the extended position.

15. The method of claim 14 further comprising the step of returning the movable wall portion to the retracted position after venting the sealed chamber.

16. The method of claim 15 further comprising repeating the providing explosive charge, positioning, detonating, venting and returning steps until the locked door is forced open.

17. The method of claim 13, further comprising the step of limiting the extent to which the door ramming surface is moved toward the door.

18. The method of claim 13 wherein the door ramming surface is positioned so that it will strike that portion of the door between the door frame and the door lock.

19. The method of claim 13 wherein the sealed chamber further comprises a chamber barrel and a firearm barrel, the chamber barrel and firearm barrel being sealably and detachably connected.

20. The method of claim 13 wherein the movable wall surface comprises a piston, and further comprising a flat blade connected to the piston and in which the door ramming surface comprises one edge of the flat blade, the flat blade further comprising upper and lower edges, each of the upper and lower edges having an ear distal from the ramming edge, a housing comprising two opposing guide rails, each guide rail having stop means, and in which the upper and lower edges of the flat blade are positioned in a respective guide rail and permit the ramming edge of the blade to project from the housing when the movable wall portion is in its extended position, such that the stops of the guide are engagable with the ears of the flat blade to limit movement of the flat blade.

* * * * *